US012161206B2

(12) United States Patent
Lynch et al.

(10) Patent No.: US 12,161,206 B2
(45) Date of Patent: Dec. 10, 2024

(54) LUGGAGE ATTACHMENT MEANS

(71) Applicants: Jane Lynch, Tarrington (GB); Katie David, Tarrington (GB)

(72) Inventors: Jane Kaur Lynch, Tarrington (GB); Katie David, Tarrington (GB)

( * ) Notice: Subject to any disclaimer, the term of this patent is extended or adjusted under 35 U.S.C. 154(b) by 81 days.

(21) Appl. No.: 17/910,006

(22) PCT Filed: Mar. 4, 2021

(86) PCT No.: PCT/IB2021/051803
§ 371 (c)(1),
(2) Date: Sep. 8, 2022

(87) PCT Pub. No.: WO2021/181216
PCT Pub. Date: Sep. 16, 2021

(65) Prior Publication Data

US 2023/0100922 A1 Mar. 30, 2023

(30) Foreign Application Priority Data

Mar. 9, 2020 (GB) ..... 2003417
Mar. 11, 2020 (GB) ..... 2003516

(51) Int. Cl.
*A45C 13/30* (2006.01)
*A45C 5/03* (2006.01)
*A45C 5/06* (2006.01)
*A45C 7/00* (2006.01)

(52) U.S. Cl.
CPC ..... *A45C 13/30* (2013.01); *A45C 5/03* (2013.01); *A45C 5/06* (2013.01); *A45C 7/0045* (2013.01); *A45C 2013/306* (2013.01)

(58) Field of Classification Search
CPC .. A45C 13/30; A45C 5/03; A45C 5/06; A45C 7/0045; A45C 2013/306; A45C 13/002
USPC ..... 150/54, 105; 190/102
See application file for complete search history.

(56) References Cited

U.S. PATENT DOCUMENTS 2,487,596 A * 11/1949 Sackstein ..... A45C 13/002 190/26
2,647,595 A * 8/1953 Meyers ..... A45C 13/002 190/26
2,724,467 A * 11/1955 Jaffe ..... A45C 13/002 190/26
7,077,251 B1 * 7/2006 Gaither ..... A45C 13/002 150/105
7,717,440 B1 * 5/2010 Baba ..... B62B 1/12 280/43.1
D667,222 S * 9/2012 Sanchez ..... D3/318
D671,316 S * 11/2012 Kritzler ..... D3/279
(Continued)

FOREIGN PATENT DOCUMENTS

EP 20152886000 A1 6/2015
KR 20090009710 A 1/2009

*Primary Examiner* — Don M Anderson
*Assistant Examiner* — Justin Caudill
(74) *Attorney, Agent, or Firm* — Jose Cherson Weissbrot

(57) ABSTRACT

An accessory for a suitcase comprising: a suitcase attachment means and a connecting means attached to the suitcase attachment means. The suitcase attachment means receives and engages with a portion of a suitcase and the connecting means connects with the connecting means of another accessory for a suitcase.

9 Claims, 2 Drawing Sheets

(56) References Cited

U.S. PATENT DOCUMENTS

| | | | | |
|---|---|---|---|---|
| 8,936,140 | B2 * | 1/2015 | Herold | A45C 13/30 190/15.1 |
| 2006/0102672 | A1 * | 5/2006 | Godshaw | A45C 13/30 224/572 |
| 2007/0204943 | A1 * | 9/2007 | Beakey | A45C 13/002 150/154 |
| 2010/0270115 | A1 * | 10/2010 | Seamon | A45C 13/002 190/26 |
| 2011/0259692 | A1 * | 10/2011 | Warncke | A45C 13/002 190/124 |
| 2013/0333996 | A1 * | 12/2013 | Selvi | A45C 13/1092 190/18 A |
| 2016/0066669 | A1 * | 3/2016 | Lien | A45C 13/42 206/459.5 |
| 2018/0192754 | A1 * | 7/2018 | Teran | A45C 5/03 |

* cited by examiner

LUGGAGE ATTACHMENT MEANS

The present invention relates to a means for attaching a first piece of luggage to a second piece of luggage, and in particular to a means for attaching a first piece of luggage to a second piece of luggage, and optionally to further additional pieces of luggage, which is retro-fitable.

BACKGROUND OF THE INVENTION

It is well known that airports and other mass transportation hubs are stressful places. Often difficult to navigate, they are filled with persons in a hurry to get from one part to another while carrying several large and unwieldy pieces of luggage.

Wheeled suitcases are now common, and have made life much easier for the weary passenger. These often have four wheels on the base, and a handle extending from the top, so that they can be pushed or pulled with either the two rear wheels in contact with the ground, or with all four wheels in contact with the ground.

Further difficulty arises, however, when a passenger has more than one piece of luggage to carry. This may be the case when he or she plans to be away from home for a long time, or has packed far more than absolutely necessary, or is accompanied by children or the elderly who are unable or unwilling to carry their own luggage. Passengers having pushchairs and/or wheelchairs to push find luggage even more difficult to manage.

It is very difficult to travel with more than one suitcase per passenger, even if all the suitcases in question are wheeled. This is because pulling each suitcase requires the exclusive use of a hand, and most passengers are limited to two hands each. Pulling two conventional wheeled suitcases with a single hand and no additional aid is fun at first but ultimately ends in tears. Cruise ships have no luggage limit, and so cruise passengers are more likely to have multiple suitcases each, making their embarking and disembarking very difficult and time consuming.

It is these difficulties which the present invention seeks to address.

Acknowledged Prior Art

The inventor is aware of the following prior art.

WO2017218419 discloses a luggage system having two suitcases slidably attachable to one another. The attachment means are fixed directly to the suitcases, either permanently or detachably. The detachable embodiment still envisages a specially adapted (and therefore more expensive) suitcase, since it only contemplates a snap-fit or press-fit arrangement. The luggage is not provided with a cover, and the use of a cover would be impossible because of the additional attachments which would be inhibited by a conventional cover.

US20170181514 discloses a luggage system comprising three specially adapted suitcases. The extendable handle of at least the largest suitcase is pivotable so as to optionally extend in a plurality of possible orientations. This allows for pulling the luggage system more conveniently, and with the addition of wheels on the rear face of the largest suitcase as well as on the undersides of each suitcase, the system can be pulled on its back as well. There is no cover, and because of the specially adapted handle and wheels, no suggestion of a system which can be used with conventional wheeled suitcases.

FR3004078 discloses a luggage system comprising at least two specially adapted suitcases. The suitcases have retractable straps which allow the first suitcase to be connected to the second suitcase. There is no suggestion of a cover, which would inhibit the disclosed system, and no possibility of using the system with a conventional wheeled suitcase.

US20190231048 discloses a luggage system comprising three specially adapted suitcases. The suitcases are attached together by means of integral attachment straps, and the rear set of wheels of the rearmost suitcase is set on a fixed-orientation axel, while the other wheels are set on multi-directional rollers. These special adaptations make it impossible to use the disclosed system with conventional wheeled suitcases.

US20130175129 discloses a luggage system comprising two specially adapted suitcases. The suitcases can be held together by means of attachment straps. The straps are not necessarily integral to the suitcases, and may be repositioned in order to hold the suitcases together in different configurations. Nevertheless, the disclosure only contemplates repositioning the straps by means of hook and loop fastenings or magnets, which still requires the special adaptation of the suitcase and prevents the use of the system with conventional wheeled suitcases.

Buying a specially modified set of luggage is expensive, and many passengers already have several suitcases of different sizes and specifications. There is a need in the art to have a system which allows a passenger to connect several conventional wheeled suitcases of different types together, for improved convenience. The present invention seeks to address this need.

STATEMENT OF INVENTION

A first aspect of the invention provides an accessory for a suitcase comprising: a suitcase attachment means; and a connecting means attached to the suitcase attachment means; wherein the suitcase attachment means is configured to receive and engage with a portion of a suitcase; and the connecting means is configured to connect with the connecting means of another accessory for a suitcase.

The suitcase attachment means may be a suitcase cover. The suitcase cover may be configured to receive a suitcase at an open end. The open end may be closable by means of at least one of: a pair of opposing flaps with mutual attachment means; a pair of opposing straps with mutual attachment means.

The suitcase attachment means may be a sleeve for encircling, in use, a portion of the body of a suitcase.

The connecting means may comprise two connectors, disposed on opposing sides of the accessory. Each of the two connectors may comprise a first connection point and a second connection points, wherein the first connection point is configured to connect with the second connection point of another accessory for a suitcase, and wherein the second connection point is configured to connect with the first connection point of the other accessory for a suitcase.

The accessory may further comprise pockets disposed on an outer surface of the suitcase attachment means.

The suitcase attachment means may be made of a stretchable material, optionally a neoprene material.

The connecting means may be extendable from the suitcase attachment means.

BRIEF DESCRIPTION OF THE DRAWINGS

The invention will be described below by way of example only, and with reference to the following figures.

DETAILED DESCRIPTION OF THE DRAWINGS

Figure 1:
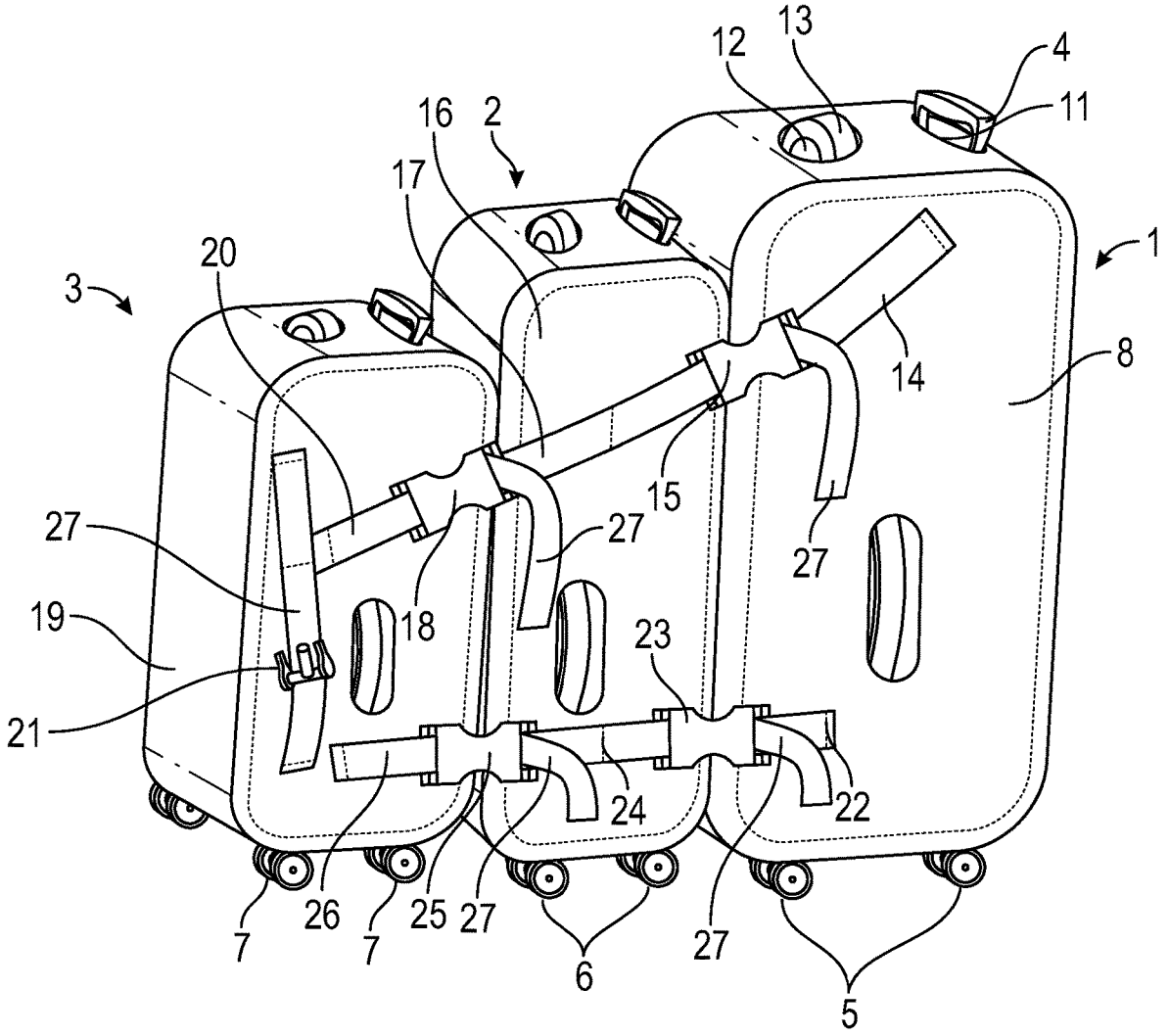
FIG. 1 depicts three suitcases held together by an embodiment of the invention.

The described embodiment is presented with three suitcases, a larger suitcase, a medium suitcase, and a smaller suitcase. The invention can be used with two suitcases, and perhaps with more than three. In the described embodiment, the first suitcase, which is the suitcase to be pulled by the user, is the largest, and the suitcases get smaller the farther they are from the first suitcase. As will be seen, the upper straps are angled in the depicted embodiment based on this assumption. Nevertheless, the angle of the straps is not an essential feature and, although it may be preferable to order the suitcases by size in this way for ease of manoeuvrability, this is by no means essential to the invention. Even in the depicted embodiment, where the upper straps are angled in the way described, suitcases of any combination of sizes can be attached by the invention, since the length of the straps is adjustable.

The described embodiment takes the form of a set of suitcase covers, with integral straps and buckles. These covers, in use, cover most of the external surface area of the suitcases to which they are applied. This is useful, because it provides the additional function of providing a protective layer around the suitcases, as well as having structural advantages for the secure attachment of the suitcases. Nevertheless, the full cover structure is not essential to the invention. The straps could alternatively be attached, for example to sleeves which wrap around or receive a portion of the suitcases.

Furthermore, although the described embodiment uses a strap and buckle for attaching the suitcases together, other connection means may be used. For example, a hook and loop system could be employed, wherein a patch of loop material is fixed to a side of the cover or sleeve, and a patch of hook material is disposed at the end of a strap extending from another cover or sleeve. The hook material and the loop material could be the other way round. Other press-fit or snap-fit connection means, or other suitable connection means, could be used, as would be clear to the skilled person.

The straps may or may not be extendable, although it is advantageous to make them extendable to allow for use with over-packed suitcases. This same advantage may be provided by other means, such as a longer patch of loop material fixed to the side of the cover or sleeve to provide a range of positions to which the strap of the other cover or sleeve may attach.

In the described embodiment, the suitcase covering elements are fixed around the underside of the suitcases by means of flaps and a hook and loop system. It will be clear to the skilled person that other means of attachment are suitable, and that different attachment means could be used together in combination as required. For example, additional straps and buckles could be provided to extend underneath the suitcase and connect together from opposing sides of the suitcase. Alternatively or additionally, flaps which zip together could extend underneath the suitcase in use from opposite sides. Although two flaps with hook and loop fastenings are depicted in the described embodiment, there may be four flaps so that, for example, the side edge flaps are connected together and the front and rear flaps are connected together, in either order.

FIG. 1 depicts a first suitcase 1, a second, smaller suitcase 2 and a third, still smaller suitcase 3. The first suitcase 1 has a first handle 4 extendable from and retractable into the top surface of the suitcase 1. Throughout this specification, where a relative position is given such as 'top' or 'bottom', it assumes an in-use orientation. For example, the 'bottom' of a suitcase is that side of the suitcase which, in use, is proximate the ground (in other words, the side which has wheels).

Four wheels 5 are provided at the bottom of the first suitcase 1, each wheel being proximate a respective corner of the bottom face of the suitcase 1.

Four wheels 6 are provided at the bottom of the second suitcase 2, each wheel being proximate a respective corner of the bottom face of the suitcase 2.

Four wheels 7 are provided at the bottom of the third suitcase 3, each wheel being proximate a respective corner of the bottom face of the suitcase 3.

The first suitcase 1 is enveloped in a first cover 8. The cover may be made from a neoprene material. This provides for a robust but stretchy cover suitable for use with various shapes and sizes of luggage and capable of surviving the rigours of airport luggage processing facilities. It will be clear to the skilled person that other materials may be used, especially materials which are stretchable and adequately robust.

The first cover 8 is of a size selected to easily fit over the first suitcase 1. It has a sock-like configuration, that is, it is open at one end and receives the suitcase 1 through the open end.

Figure 2:
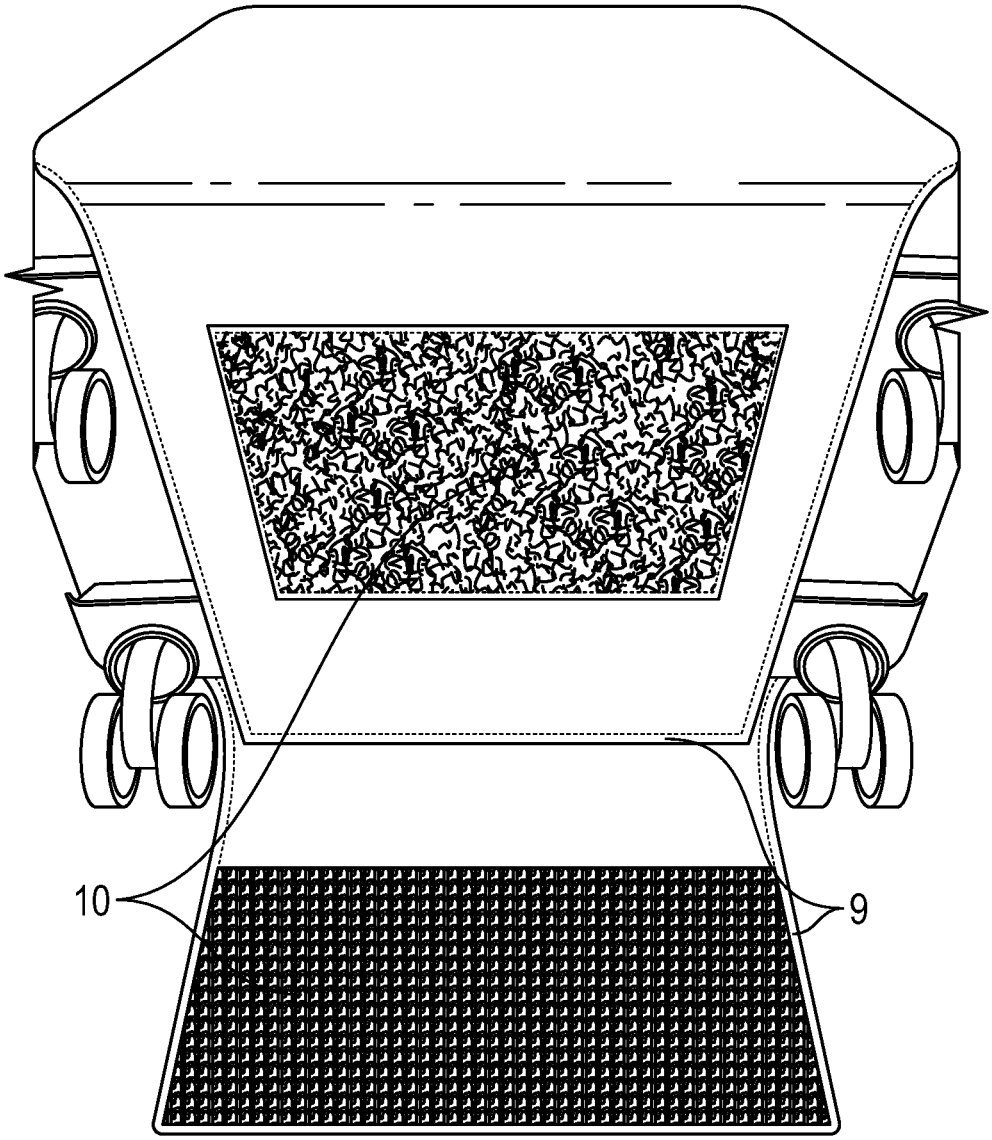
FIG. 2 depicts an embodiment the invention in the process of being fastened underneath a suitcase.

The first cover 8 has at least two flaps 9 (see FIG. 2) proximate the open end, which fold underneath the bottom face of the suitcase 1 and attach together, so that the bottom surface is covered. In the depicted embodiment, the flaps 9 attach together by means of a hook and loop fastening 10.

A first slit 11 is provided in the cover 8 corresponding to the position of the first handle 4. This enables the first handle 4 to be extended in use without hindrance by the first cover 8.

A second slit 12 may be provided. Many conventional suitcases have a second handle 13 on the top surface, used for lifting the suitcase rather than pulling it, and this can be accommodated by the provision of a second slit 12.

An upper strap 14 is provided on each side edge of the cover 8 (that is, on the portions of the cover which cover, in use, the sides of the suitcase). The upper strap 14 has a rear end disposed in use proximate the rear of the suitcase, and a front end disposed in use proximate the front of the suitcase. When used herein, the 'rear' of the suitcase is that which faces the direction in which a wheeled suitcase is conventionally pulled.

The upper strap 14 may fixed to the cover 8 by stitching, or by any other suitable means known to the skilled person. The fixing may be permanent or temporary, i.e. the straps may be removably attached to the covers. The same applies to the other straps that will be described below.

In the depicted embodiment, a male portion of a buckle 15 is disposed at the front end of the upper strap 14. Nothing is disposed at the rear end of the upper strap 14, because the depicted first cover 8 has been designed for the first suitcase in a train of suitcases. This need not be the case, and a female portion of a buckle could be disposed at the rear end, for connection to another cover of the invention covering a suitcase.

The upper strap 14 is fixed to the cover 8 in a diagonal configuration, being closer in use to the top of the suitcase at its rear end than at its front end. As already discussed, this is an optional feature particularly advantageous when successive suitcases in a train of suitcases will get smaller.

The second suitcase 2 has a second cover 16 of the invention. This is also provided with an upper strap 17, having a female part of buckle 15 attached to its rear end. The upper strap 17 of the second cover 16 is thereby connectable to the upper strap 14 of the first cover 8.

The upper strap 17 of the second cover 16 is further provided with a male part of a buckle 18.

The third suitcase 3 has a third cover 19 of the invention. This is also provided with an upper strap 20, having a female part of buckle 18 at its rear end. The upper strap 20 is thereby connectable to the upper strap 17 of the second cover 16.

The upper strap 20 of the third cover 19 is further provided with a male part of a buckle 21. This would enable it to connect to a fourth suitcase cover (not shown). It will be clear that this is not necessarily the case; if the third suitcase cover 19 is designed to cover the last suitcase in a train, it may optionally lack a male buckle part 21 at the front end of its upper strap 20.

The first cover 8 is further provided with a lower strap 22, on the portion which covers, in use, the side of the suitcase 1, proximate the bottom of the suitcase 1. The lower strap 22 has a front end and a rear end. A male part of a buckle 23 is fixed at the front end of the lower strap. Optionally, a female part of another buckle (not shown) may be provided at the rear end of the lower strap.

The lower strap may also be fixed in a diagonal configuration, but this is not essential. In the depicted embodiment, the lower strap is slanted with a shallower gradient than the upper strap.

The second cover 16 is also provided with a lower strap 24, having a female part of buckle 23 at its rear end, and a male part of a buckle 25 at its front end.

The third cover 19 also has a lower strap 26. This has a female part of buckle 25 at its rear end and, optionally, a male part of another buckle (not shown) at its front end.

The male parts of the buckles 15, 18, 21, 23, 25 are provided with extension straps 27. This is convenient for making the covers 8, 16, 19 of the invention more versatile, usable for differently shaped suitcases and even over-filled suitcases. It will be clear to the skilled person that other extension options are available. For example, the extension straps 27 could be provided for the female buckle parts, or for both the male and female buckle parts.

While FIG. 1 shows the embodiment from one side, it should be clear that corresponding upper and lower straps are provided on the other sides of the covers 8, 16, 19, so that in use they connect the suitcases together on both sides.

Although male and female buckles have been presented as the connecting means between the covers, it will be clear to the skilled person that many other connection means may be suitable. For example, hook and loop or other touch fasteners may be used, or other push fit or snap fit options may be selected.

Although upper and lower connecting means have been presented herein, other configurations may also be suitable. The inventor has found an upper connecting means and a lower connecting means to be advantageous to the stability of the train of suitcases. Nevertheless, it is possible to have a single connecting means near the top, or in the middle, on each side. Alternatively, more than two connecting means could be selected.

Each of the covers 8, 16, 19 may also be provided with further slits or holes for other handles. Many conventional suitcases have side handles so that they can be carried sideways. The covers 8, 16, 19 are reversible so they can provide for handles on either side of the suitcase. Alternatively a hole can be provided on both sides for handles.

Each of the covers 8, 16, 19 may be provided with other useful features for travelling. For example, they may be provided with front, rear, side, or top pockets (not shown) which allow for easy access to items such as travel documents and currency. Optionally, these features may be provided only on the front (in use) face of the cover designed to be the last in the train, or on the rear (in use) face of the cover designed to be the first in the train.

One particularly useful optional feature is a pocket for each strap, each of said pockets being disposed proximate the point at which its respective strap is fixed to the cover. When the straps are not in use, that is, when their respective buckles or other connections means are not in use for connecting to another buckle or connection means, said straps along with their buckles or other connecting means can be tucked into their respective pockets.

The invention has been described with reference to preferred embodiments. The described embodiments are not limiting. The scope of the invention is determined by the claims.

The invention claimed is:

1. An accessory for a suitcase comprising:

a suitcase attachment means includes a first cover, a second cover, and a third cover; and a connecting means attached to the suitcase attachment means;

wherein the suitcase attachment means receives and engages with a portion of a suitcase;

each of the first cover, the second cover, and the third cover includes an upper strap and a lower strap, the upper strap is fixed to the first cover in a diagonal configuration:

the suitcase attachment means is made of a stretchable material; and the connecting means connects with the connecting means of another accessory for a suitcase.

2. The accessory for the suitcase according to claim 1, wherein the suitcase attachment means is a suitcase cover.

3. The accessory for the suitcase according to claim 2, wherein the suitcase cover is configured to receives a suitcase at an open end.

4. The accessory for the suitcase according to claim 3, wherein the open end is closable by means of at least one of:

a pair of opposing flaps with mutual attachment means;

a pair of opposing straps with mutual attachment means.

5. The accessory for the suitcase according to claim 1, wherein the suitcase attachment means is a sleeve for encircling, in use, a portion of the body of a suitcase.

6. The accessory for the suitcase according to any preceding claim wherein the connecting means comprises two connectors, disposed on opposing sides of the accessory.

7. The accessory for the suitcase according to claim 6 wherein each of the two connectors comprises a first connection point and a second connection points, wherein the first connection point is configured to connect with the second connection point of another accessory for a suitcase, and wherein the second connection point is configured to connect with the first connection point of the other accessory for a suitcase.

8. The accessory for the suitcase according to claim 1, wherein the suitcase attachment means is made of a neoprene material.

9. The accessory for the suitcase according to claim 1, wherein the connecting means is extendable from the suitcase attachment means.

* * * * *